US011060294B2

(12) United States Patent
Beltramo, Jr.

(10) Patent No.: US 11,060,294 B2
(45) Date of Patent: Jul. 13, 2021

(54) GUTTER BALL DOWNSPOUT CORD CONVEYANCE METHOD AND MECHANISM

(71) Applicant: Daniel A. Beltramo, Jr., Menlo Park, CA (US)

(72) Inventor: Daniel A. Beltramo, Jr., Menlo Park, CA (US)

( * ) Notice: Subject to any disclaimer, the term of this patent is extended or adjusted under 35 U.S.C. 154(b) by 322 days.

(21) Appl. No.: 15/960,914

(22) Filed: Apr. 24, 2018

(65) Prior Publication Data

US 2019/0127984 A1 May 2, 2019

Related U.S. Application Data

(60) Provisional application No. 62/577,912, filed on Oct. 27, 2017.

(51) Int. Cl.

| | |
|---|---|
| ***E04D 13/08*** | (2006.01) |
| ***E04D 13/00*** | (2006.01) |
| ***E04D 13/076*** | (2006.01) |

(52) U.S. Cl.

CPC ..... *E04D 13/08* (2013.01); *E04D 13/008* (2013.01); *E04D 13/0767* (2013.01); *E04D 2013/086* (2013.01)

(58) Field of Classification Search

CPC ... E04D 13/008; E04D 13/08; E04D 13/0767; E04D 2013/086

See application file for complete search history.

(56) References Cited

U.S. PATENT DOCUMENTS

| | | | | |
|---|---|---|---|---|
| 2,813,593 A | | 11/1957 | Gladding | |
| 3,292,198 A | * | 12/1966 | Perkel | E04D 13/0765 15/104.16 |
| 3,426,866 A | | 2/1969 | Jensen | |
| 3,716,076 A | | 2/1973 | Franzmeier | |
| 4,433,449 A | * | 2/1984 | Rainey | F23J 3/026 15/104.067 |
| 4,852,308 A | * | 8/1989 | Papenbrock | E04D 13/076 52/12 |
| 5,159,789 A | * | 11/1992 | Haapanen | E04D 13/08 52/12 |
| 5,657,582 A | | 8/1997 | Chitwood | |
| 5,802,775 A | * | 9/1998 | Toth | E04D 13/0767 210/163 |
| 7,469,504 B2 | * | 12/2008 | Nocella | E04D 13/0767 210/350 |
| 8,656,947 B1 | * | 2/2014 | Barton | E04D 13/08 137/544 |

FOREIGN PATENT DOCUMENTS

| | | | | |
|---|---|---|---|---|
| FR | 2815657 A1 | * | 4/2002 | E04D 13/08 |

* cited by examiner

*Primary Examiner* — Edgardo San Martin
(74) *Attorney, Agent, or Firm* — Kirk Dorius; Dorius Law P.C.

(57) ABSTRACT

A downspout cord or the like conveyance device and method, comprised of a sufficiently heavy and at least partially rolling mass, preferably that rotates around an axle which is connected to a harness and to which a cord or the like may be attached and pulled down a bent downspout largely by the force of gravity.

11 Claims, 5 Drawing Sheets

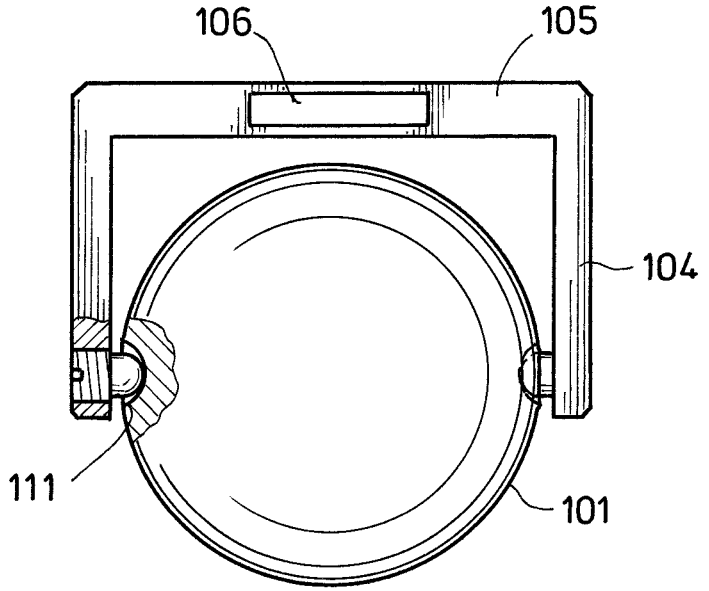
FIG.7
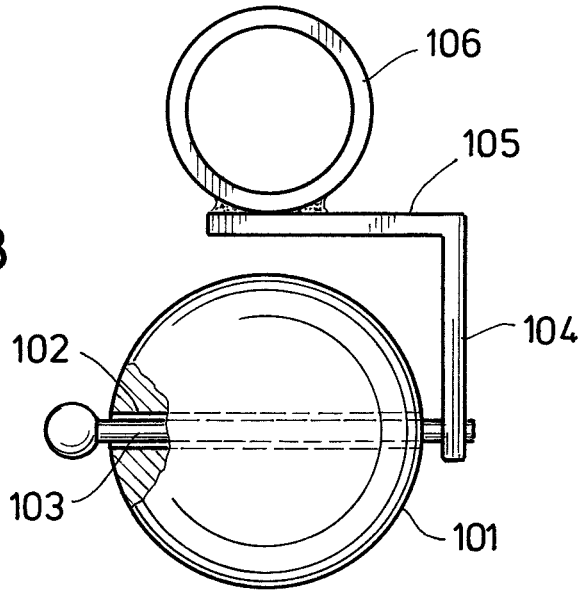
FIG.8
FIG.9
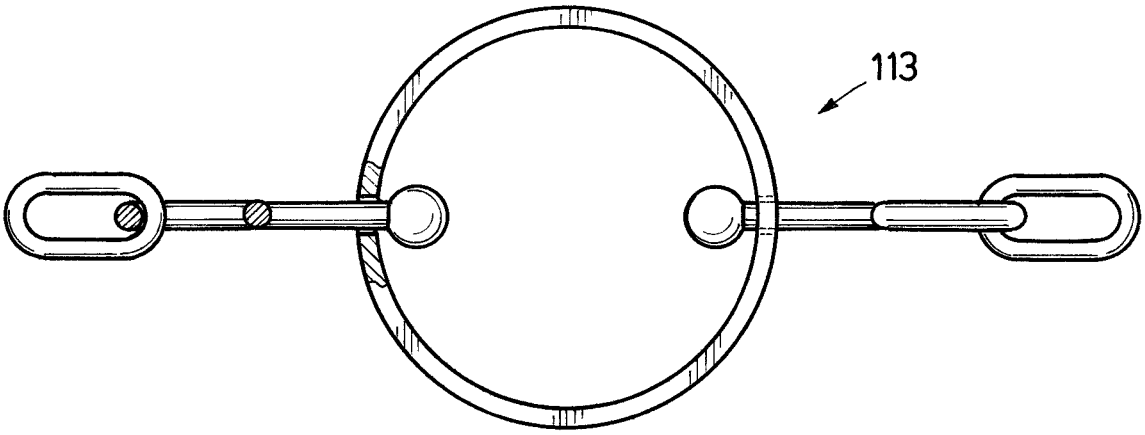

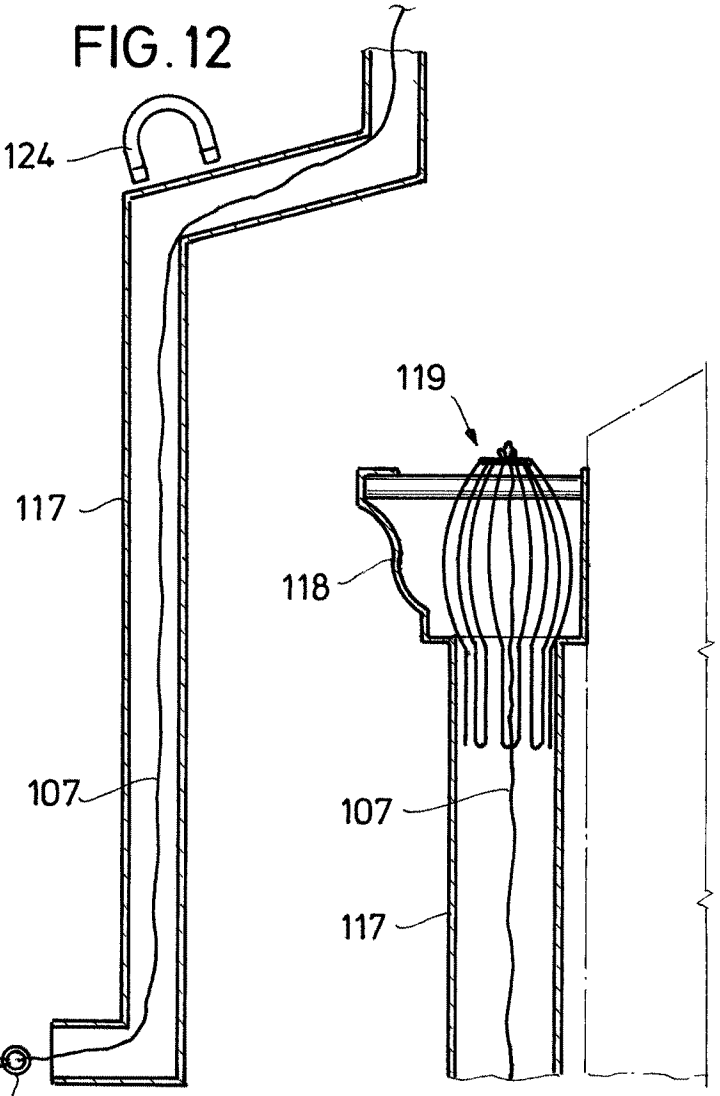
FIG. 12
FIG. 14
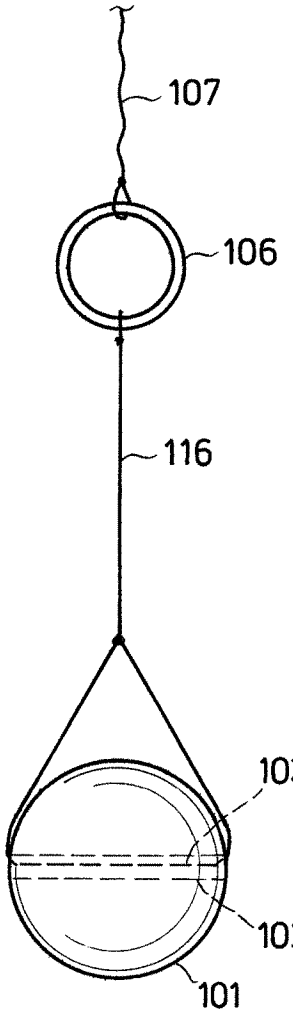
FIG. 11
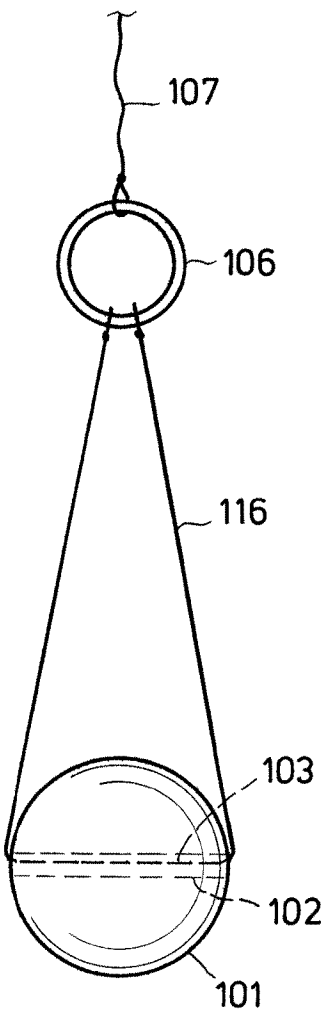
FIG. 10

GUTTER BALL DOWNSPOUT CORD CONVEYANCE METHOD AND MECHANISM

This application relates to and claims priority to provisional application Ser. No. 62/577,912, filed Oct. 27, 2017, entitled Gutter Ball Downspout Cord Conveyance Method And Mechanism, having inventor Daniel A. Beltramo, Jr. The contents of the referenced provisional application is herein and hereby incorporated by reference in its entirety.

FIELD OF THE INVENTION

The present invention relates to silencing the sound of water dripping in a downspout. More particularly the invention addresses the problem of inserting a cord or the like through a downspout, typically one or more stories in height, such that the water may flow down the cord instead of dripping from a top end of a length of downspout to a bottom end.

BACKGROUND OF THE INVENTION

The use of devices to reduce or eliminate the sound of water dripping down a downspout is known. By way of example U.S. Pat. No. 3,716,076A describes an angular gutter connection. U.S. Pat. No. 3,426,866 describes a downspout muffler. U.S. Pat. No. 5,657,582 describes a rain gutter downspout noise attenuation device. U.S. Pat. No. 2,813,593 describes a downspout muffler. Gutterworks.com by Front Street Manufacturing, Inc. sells a downspout silencer (https://www.gutterworks.com/shop-online/downspout-products-2/downspout-silencers-56). RainQuiet makes a downspout insert (http://rainquiet.com/).

While these devices appear to fulfill their respective objectives and requirements, the aforementioned patents and devices do not disclose a device to easily insert a cord or the like through the length of a bent downspout, especially a gutter and downspout assembly with multiple bends in it. In this respect, the present invention substantially departs from the conventional concepts and designs of the prior art.

A bent downspout will be understood herein to refer to a downspout with one or more bends of angles summing up to at least 90 degrees. A minimally bent downspout will refer to a straight downspout with two 45 degree bends intermediate the beginning and the end of the downspout.

The concept of inserting a cord or the like into downspouts as a means of eliminating dripping is documented in building maintenance literature. Such can be an acceptable solution for essentially straight, vertical downspouts, as depicted in FIG. 15. When a downspout has one or more bends or curves, as in FIGS. 12 and 13, however, one is faced with the classic, idiomatic dilemma of "pushing rope." While some materials can be forced to move sideways along a predominantly horizontal portion of a downspout, by exerting a vertical downward force on them, those same materials cannot readily be induced to bend a second time in order to proceed vertically downward. Materials with the flexibility to snake through multiple bends in a downspout are too pliable to be significantly pushed.

It can be appreciated thus that there exists a continuing need for a way to insert a cord, rope, ribbon, strap, wire, chain or other long, flexible material through a bent downspout (such that water may subsequently flow down the cord or the like instead of dripping from one end of a length of downspout to the other.) The insertion mechanism, length of flexible material, and method should accommodate the interior dimensions of standard gutter outlets and downspouts which generally exceed $1\frac{11}{16}$ inches and be able to accommodate bent downspouts of at least one story, or at least six feet, in height. The present invention substantially fulfills this need.

OBJECTS OF THE INVENTION

It is a preferred object of the present invention to provide a new mechanism and method to convey a cord down a downspout of one or more stories in height and, in particular, a downspout with bends and curves.

It is a preferred object of the present invention that it makes use of gravity and the inclined nature of various segments of downspouts for an object to roll at least partially, and/or fall and/or slide down the entire length of a downspout.

It is a preferred object of the present invention that the weight of the rolling object is sufficient to drag or pay-out or unwind a cord through the length of a downspout.

It is a preferred object of the present invention that it will allow a cord to be fastened and unfastened to it.

It is a preferred object of the present invention that it could accommodate various types of cords, straps, strings, chains, ropes or lengths of flexible material.

It is a preferred object of the present invention that the rolling object portion of the invention may be a ball, cylinder, wheel or any other object or set of objects that are inclined to at least partially roll. It is a preferred object of the present invention that an axle shaft may be significantly narrower than an axle bore to facilitate lateral rolling in addition to forward rolling.

It is a preferred object of the present invention that the harness be lightweight in relation to the heavy rolling object, closely contoured around the heavy rolling object, and balanced in such a way as to allow the heavy rolling object to roll freely.

It is a preferred object of the present invention that the upper end of the cord that has been conveyed through the downspout may be affixed in such a way that it does not slide down the downspout.

It is a preferred object of the present invention that the mechanism to which to attach the cord may swivel and or spin in such a way as to diminish any torsional or directional forces exerted on the present invention by the cord.

It is a preferred object of the present invention that the rolling object may be left attached to the cord that has traversed the downspout as a weight that may apply tension to a cord that is affixed to the top of the downspout or gutter.

It is a preferred object of the present invention that it may or may not be re-used to convey cords through multiple downspouts or multiple cords through a single downspout.

It is a preferred object of the present invention that the harness may be made of a guide wire or may comprise fishing line threaded through an axle bore such that having traversed a downspout, it may be used to pull through a suitable drip cord.

It is a preferred object of the present invention that the top end of a cord that passes through the length of a downspout may be affixed to an object intended to prevent debris from flowing down the downspout such as a gutter strainer or gutter spring.

It is a preferred object of the present invention to provide a new downspout cord conveyance mechanism which is of durable and reliable construction.

It is a preferred object of the present invention to provide a new downspout cord conveyance mechanism which may be easily and efficiently manufactured and marketed.

Additionally, it is a preferred object of the present invention to provide a new mechanism and method to convey a cord down a gutter and downspout assembly utilizing a heavy rolling object attached to a harness mechanism which is attached to a cord.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

(Before explaining embodiments of the invention in detail, it is to be understood that the invention is not limited in its application to the details of construction and to the arrangements of the components as set forth in the following description or as illustrated in the drawings. The invention is capable of other embodiments and of being practiced and carried out in various ways. The phraseology and terminology employed herein are for the purpose of description and should not be regarded as limiting. The conception, upon which this disclosure is based, may readily be utilized as a basis for the designing of other structures, methods and systems for carrying out the several purposes of the present invention. It is important that the claims be regarded as including such equivalent constructions insofar as they do not depart from the spirit and scope of the present invention. The purpose of the abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.)

SUMMARY OF THE INVENTION

In view of the foregoing disadvantages inherent in known types of downspout water noise attenuation devices now present in the art, the present invention provides a new mechanism and method to convey a cord or the like through a downspout, typically equal to our greater than one story in height, for purposes of noise attenuation and drip elimination. As such, the general purpose of the present invention, which will be described subsequently in greater detail, is to provide an effective, economical means to convey a cord or the like through a downspout, in particular, a downspout with bends and curves. (The word "cord" is used generically herein to include any flexible length of material including but not limited to string, ribbon, rope, chain, wire, band, strap.)

To attain this, a preferred embodiment of the present invention is comprised of a heavy, at least partially rolling object, for example a ball, or a mass with rollers or bearings that rotate freely, potentially about an axis. The object should be dimensioned and constructed with respect to a bent downspout so as to freely move, roll and/or fall. Attached in some fashion to the rolling/moving object is a harness or shaft of some design which may be connected to, a cord or the like. The entire assembly should be narrower than the interior width of standard connection tubes between a gutter and downspout, also known as outlets, and narrower than standard downspouts themselves. 1¾ inches is the narrowest common exterior diameter or length of any of these dimensions with the interior dimension potentially being slightly less than that depending on the type and gauge of material from which the downspout or outlet is constructed.

In order to stop dripping sounds in a downspout, an operator can attach cord to the downspout cord conveyance device and then drop the downspout cord conveyance system into an outlet, hole or tube connecting a gutter to a downspout. Gravity induces the at least partially rolling object to roll and/or WI down the downspout, dragging the cord or the like behind it, or in alternate embodiments, reeling out the cord.

The operator can secure an end of the cord not connected to the downspout cord conveyance device such that that cord end does not slide down the gutter and downspout. There are numerous ways to do this, one of which is to simply affix the cord to an object, through which water can pass, but that is larger than the hole in the gutter where it connects to the downspout. Such device is often called a gutter or downspout strainer, downspout balloon, downspout ball, or downspout spring. At the bottom end of the downspout, the operator may leave the downspout cord conveyance system attached to the cord or remove it. The bottom end of the cord may or may not then be clipped to a lip of the downspout to secure it.

The following disclosure of embodiments of the invention offers a more detailed description of the invention such that aspects of the invention may be better understood, and in order that the contribution to to the art may be better appreciated.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 offers a front view, perpendicular to principal axis of rotation of a cord conveyance system, with partial cross section, featuring partial transverse axles inset into axle dimples as opposed to a full axle bore.

FIG. 8 offers at view, with partial cross section, perpendicular to an axle bore of an embodiment, featuring a single strut and axle ball to prevent an axle shaft from slipping out of the bore.

FIG. 9 offers a side view of a swiveling cord-to-harness attachment mechanism.

FIG. 10 offers side view of an embodiment of a cord conveyance system in which a guide wire passes through an axle bore and serves as an axle for a downspout cord conveyance system.

FIG. 11 offers a side view of an embodiment of a cord conveyance system in which a loop at the end of a guide wire passes through an axle bore and serves as an axle for a downspout cord conveyance system.

FIG. 12 offers a side view of a downspout through which a downspout cord conveyance system has passed and left behind a cord and with a source of magnetic power illustrated.

FIG. 14 illustrates cord connected to gutter strainer.

Figure 1:
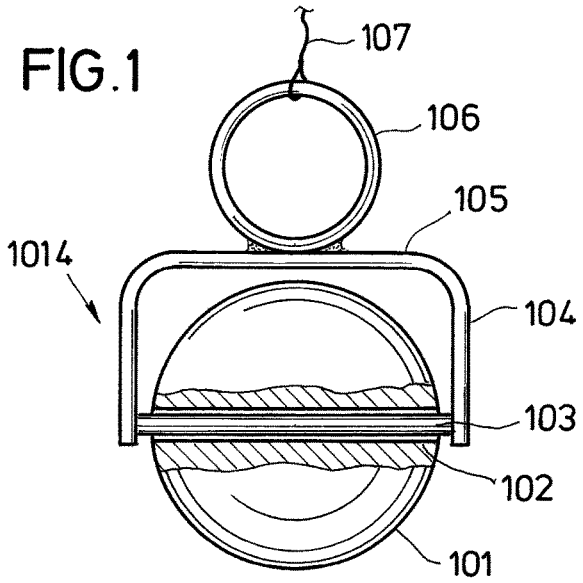
FIG. 1 offers a front view, perpendicular to an axle bore, with partial cross section, of a preferred embodiment of a downspout cord conveyance.
Figure 2:
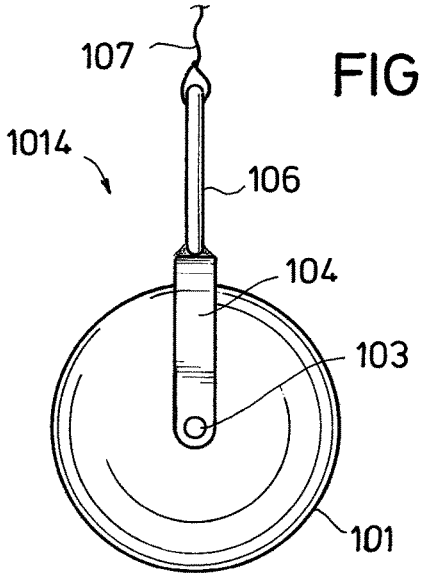
FIG. 2 offers a side view of the preferred embodiment of FIG. 1 of the downspout cord conveyance system, looking at the system parallel to the axle bore, FIG. 3 offers an elevation view of a heavy rolling element of the downspout cord conveyance system of FIG. 1.
Figure 3:
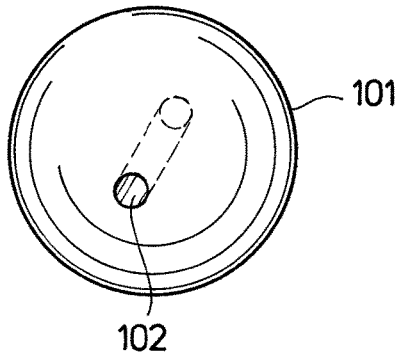
Figure 4:
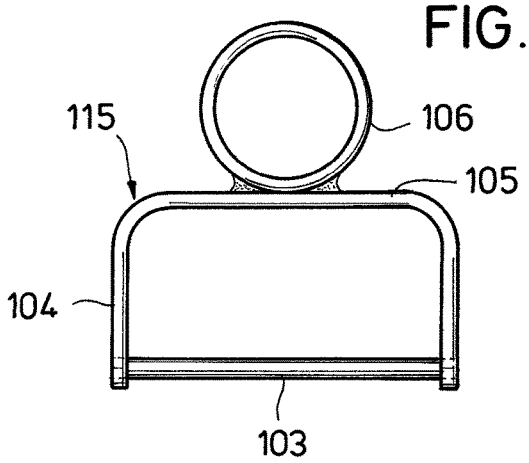
FIG. 4 offers a front view, perpendicular to an axle bore, of a strut, strut connector and cord assembly system.

The drawings are primarily illustrative. It would be understood that structure may have been simplified and details omitted in order to convey certain aspects of the invention. Scale may be sacrificed to clarity.

DESCRIPTION OF PREFERRED EMBODIMENTS

With reference now to the drawings, and, in particular, to FIGS. 1-4 and 7-8 thereof, one preferred embodiment of a downspout cord conveyance device embodying principles and concepts of the present invention, and generally designated by the reference number 1014, will be described.

In this embodiment, device 1014 consists of a heavy rolling and/or falling/sliding object or mass (such as a ball) 101 as shown in the figures. Preferably the object rotates rather freely, such as around an axle shaft 103 depicted in diagrams 1-4 and 8 that runs through an axle bore 102 that traverses roughly the center of heavy rolling/falling/sliding object 101. Each end of axle shaft 103 may be attached to a harness strut 104 as depicted in FIGS. 1-2, 4, and 7-8. The ends of each strut 104 that are not connected to the axle shaft are attached by a harness strut connector 105 as depicted in FIGS. 1-2, 4 and 7-8. A cord 107 as depicted in FIGS. 1-2, 10-12, 14 and 19 may be connected to the strut connector 105 via a fastening mechanism 106. The entire assembly preferably has a maximum lateral diameter in use that is less than the minimum lateral interior diameter of standard connection tubes between a gutter 118 and a downspout 117, outlets, and less than a minimum diameter of a standard downspout 117. The axle shaft 103, struts 104, strut connector 105 and fastening mechanism 106 may be individual pieces, sub-assemblies, or one piece, may be rigid, semi rigid or fully flexible in whole or on part and together form a harness 115 as depicted in FIGS. 1-2, 4, 6-8, and 10-11. When the downspout cord conveyance device 1014 and harness 115 is attached to a cord 107 and dropped into a downspout 117, the downspout cord conveyance system 1014 rolls/falls/slides down the downspout 117 pulling the cord behind it as depicted in FIG. 12. The cord 107 at the top end of the downspout 117 may be affixed there in a variety of manners such as by connecting it to a device intended from preventing debris from flowing down a down spout 117, such as a gutter strainer 119 as depicted in FIG. 14.

Figure 5:
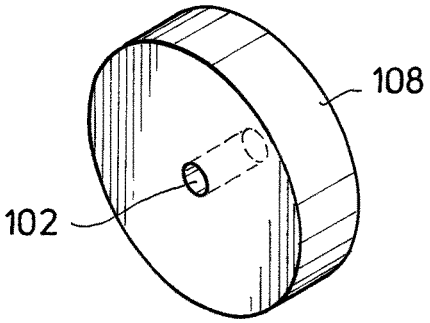
FIG. 5 offers a perspective view of an alternate heavy rolling object, in this case a cylinder or wheel, of a downspout cord conveyance system.
Figure 6:
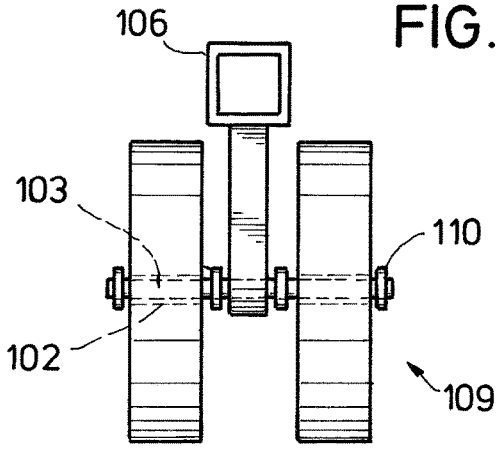
FIG. 6 offers a front view perpendicular to an axle bore of an embodiment of a cord conveyance system featuring a set of wheels acting as heavy rolling objects.
Figure 13B:
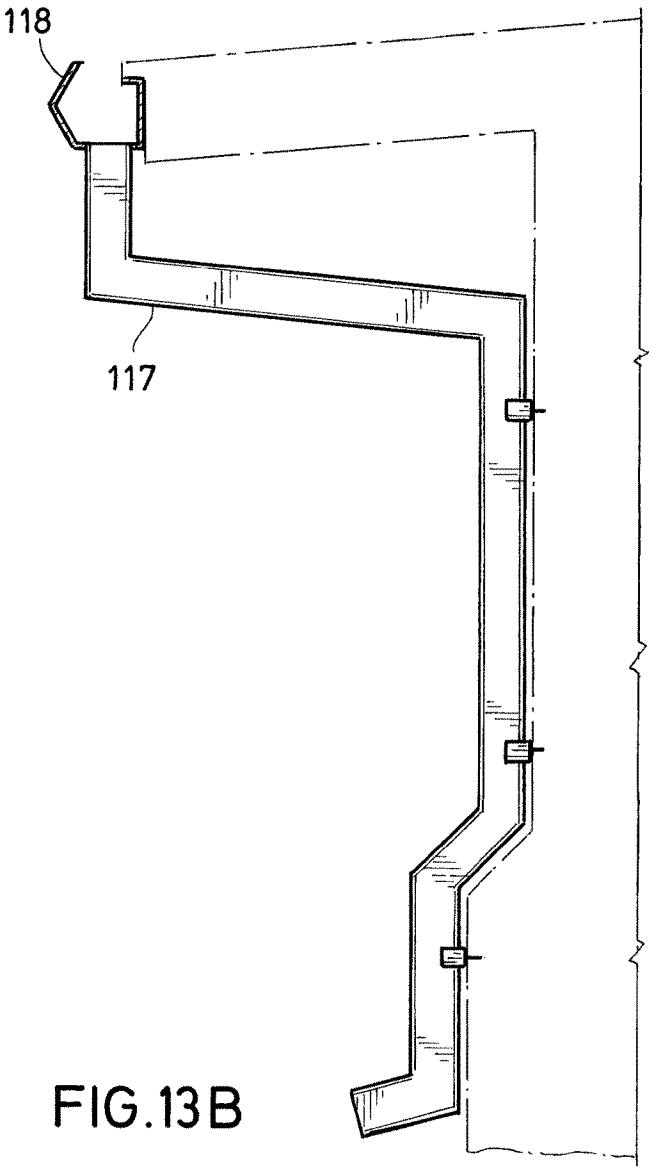
FIGS. 13A and B illustrate bent downspouts for which embodiments of the present invention are particularly applicable.
Figure 13A:
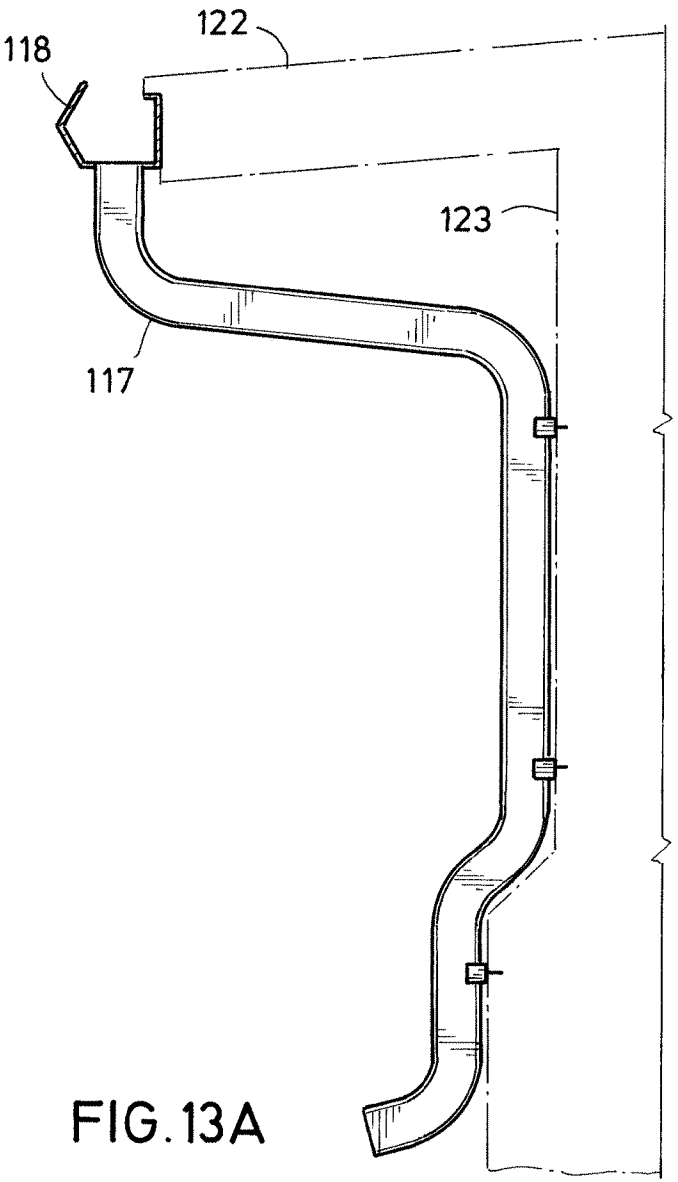

The heavy rolling/falling/sliding object or mass 101 may come in various shapes or combinations of shapes such as, in addition to a ball, a heavy rolling cylinder 108 depicted in FIG. 5 or heavy rolling wheels 109 depicted in FIG. 6 that may be held in place on an axle shaft 103 by axle disks 110 as depicted in FIG. 6.

The operative axle shaft 103 need not traverse an entire axle bore 102 and may be comprised of partially transverse axle shafts 112 that fit within axle bore dimples 111 or end portions of an axle bore 102 as depicted in FIG. 7.

The cord 107 may be affixed directly to a strut connector 105, a fastening mechanism 106, or via a swiveling connector 113 as depicted in FIG. 9 attached to a harness which would reduce any forces upon the heavy rolling object 101 from the cord 107 and facilitate free rotation.

The harness could, of course, simply comprise fishing line or the like threaded through an axis bore of the mass 103 with, preferably both ends extending up to the top or beginning of the downspout 117, such that an operator can partially control the rolling/falling/sliding mass 101 by jiggling the lines as depicted in FIG. 10 The harness could also comprise a fishing line or the like tied in a loose loop that passes through the axel bore 102 and allows for the rotation of the heavy rolling object or mass 101 as depicted in FIG. 11.

In an alternate embodiment, a guide wire 116 may serve as an axle shaft 103. Once a downspout cord conveyance system 1014 using a guide wire 116 or fishing line as an axle shaft 103, passes through a downspout 117, the guide wire 116 or line may be attached to cord. 107 and pulled through the downspout 117 as depicted in FIG. 12-15.

Figure 15:
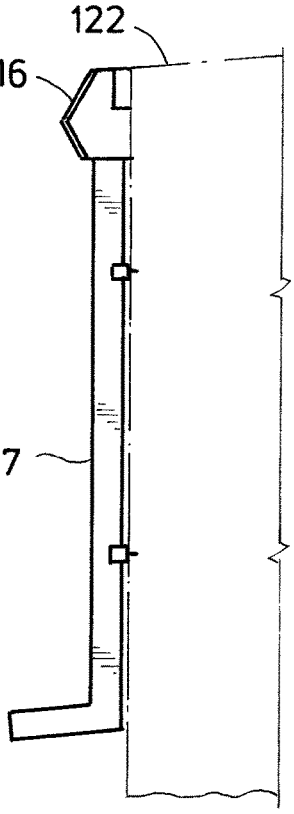
FIG. 15 illustrates a non-substantively bent, vertical downspout alongside a building connected to a gutter at the top.

FIG. 15 depicts a vertical downspout 117 through which a cord 107 could be dropped straight down without the need of a cord conveyance device 114 to navigate bends in the downspout 117. The downspout is depicted connecting to a gutter 116 then connects to a roof 122 that runs along the side of a building 123.

Figure 16:
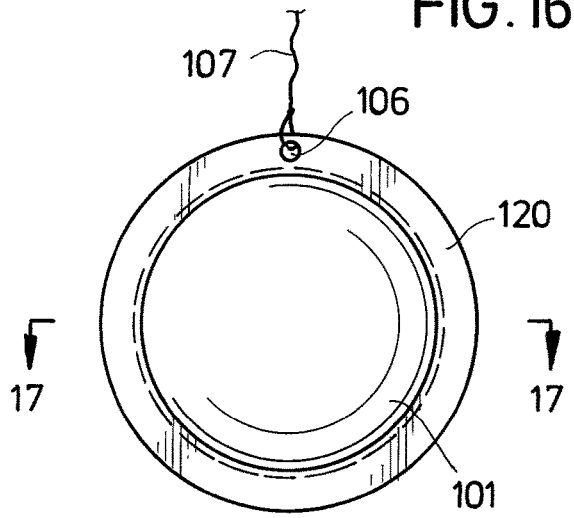
FIG. 16 illustrates a side view of an embodiment of a cord conveyance system in which a ring-shaped harness contains a heavy rolling object by means of concave internal surfaces of the ring that has an interior radius that is slightly larger than the exterior radius of the heavy rolling object such that the heavy rolling object can roll freely, but not exit the harness.
Figure 17:
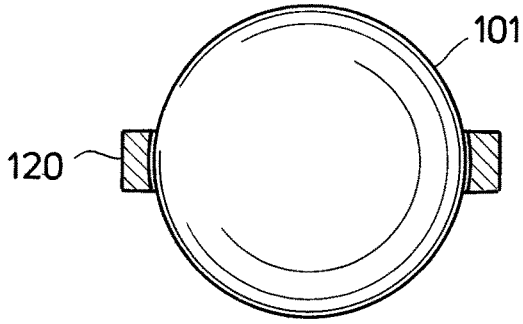
FIG. 17 offers a cross section of an embodiment of a cord conveyance system in which a ring-shaped harness contains the heavy rolling object by means of a concave internal surface of the ring that has an interior radius that is slightly larger than the exterior radius of the heavy rolling object such that the heavy rolling object can roll freely, but not exit the harness.
Figure 18:
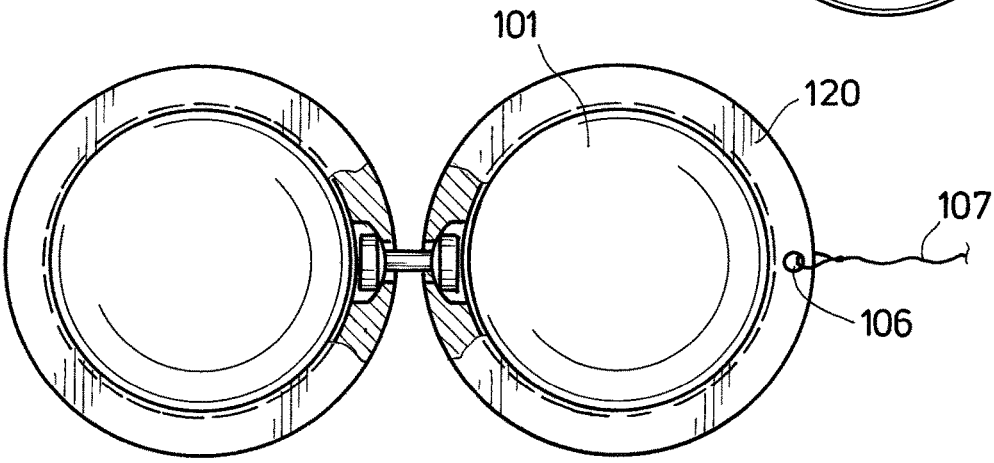
FIG. 18 offers a side view an embodiment of a cord conveyance system in which two connected ring-shaped harnesses contain two heavy rolling objects by means of concave internal surfaces of the rings that have interior radii slightly larger than the exterior radii of the heavy rolling objects such that the heavy rolling objects can roll freely, but not exit the harnesses.

FIGS. 16-18 depict an embodiment of the cord conveyance device 1014 in which the heavy rolling object 101 is contained in a harness 115 that is constructed as a race 120. FIG. 18 is an embodiment in which two race 120 type harnesses 115 are connected.

Figure 19:
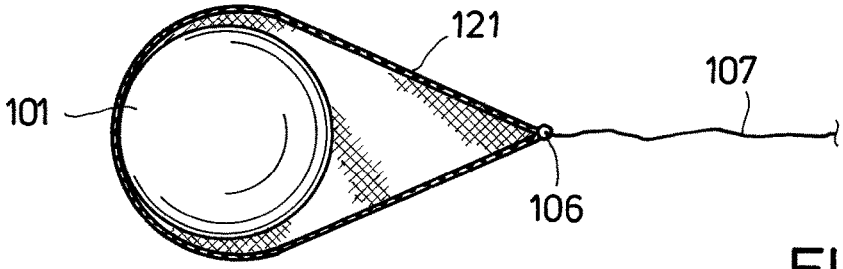
FIG. 19 offers a side view of an embodiment of a cord conveyance system in which the heavy rolling object is contained in a light weight, flexible sack with a low coefficient of friction that serves as a harness which allows for the heavy rolling object to roll freely. The sack-like harness is depicted connected to a cord.

FIG. 19 depicts an embodiment of the cord conveyance device 1014 in which the heavy rolling object 101 is contained in a harness 115 that is a sack 121.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. A downspout material conveyance device for bent downspouts comprising: a mass sized and structured to rotate around a mass axle bore defined therein, to roll, at least in part, down a bent downspout; a length of material sufficient to traverse a downspout, connected directly or indirectly to said mass by a harness; and with said mass, harness and length of material structured in combination to pull or pay-out or unwind the length of material down a minimally bent vertical downspout.

2. The device of claim 1 including a ferromagnetic mass and a source of magnetic energy structured in combination with the mass such that the source induces the mass to proceed through a downspout.

3. The device of claim 1 including a harness with a shaft structured for connection into or through the mass axle bore.

4. The device of claim 1 including a swivel connection mechanism between the mass and the length of material structured for reducing twisting forces exerted between the mass and the length of material as the mass rotates about an axle extending through the bore defined therein.

5. The device of claim 1 including the length of material connected to a device for preventing debris from entering a downspout.

6. The device of claim 5 wherein the debris preventing device includes a gutter strainer or a gutter spring.

7. The device of claim 1 wherein the harness and length of material include flexible line or wire.

8. The device of claim 1 wherein the length of material comprises rope cord.

9. A method of conveying a length of material down a bent downspout, comprising: attaching a length of material to a mass by a harness, the harness comprising an axle extending through an axle bore defined in the mass, the combination structured to fit through a gutter outlet and a minimally bent downspout such that gravity moves the combination through the bent downspout while pulling, paying out or unwinding the length of material; dropping said mass into a downspout; providing a sufficient length of material such that the material may be secured at the top of the downspout and extend through the length of the downspout; attaching a top end of material that traverses the length of the downspout to the gutter or to proximate a top of the downspout; and detaching the mass from the length of material at the bottom of the downspout.

10. The method of claim 9 wherein the length of material is attached to a gutter strainer.

11. The method of claim 9 wherein the length of material is used to pull another length of different material through the downspout.

* * * * *